US011381027B2

(12) United States Patent
Hsiao et al.

(10) Patent No.: US 11,381,027 B2
(45) Date of Patent: Jul. 5, 2022

(54) ELECTRONIC CONNECTOR

(71) Applicant: BIZLINK INTERNATIONAL CORPORATION, New Taipei (TW)

(72) Inventors: Hsin-Tuan Hsiao, New Taipei (TW); Jui-Hung Chien, New Taipei (TW)

(73) Assignee: BIZLINK INTERNATIONAL CORPORATION, New Taipei (TW)

( * ) Notice: Subject to any disclaimer, the term of this patent is extended or adjusted under 35 U.S.C. 154(b) by 0 days.

(21) Appl. No.: 17/101,080

(22) Filed: Nov. 23, 2020

(65) Prior Publication Data

US 2021/0257773 A1 Aug. 19, 2021

(30) Foreign Application Priority Data

Feb. 18, 2020 (TW) ..... 109201796

(51) Int. Cl.
*H01R 13/506* (2006.01)
*H01R 13/629* (2006.01)
*H01R 9/03* (2006.01)

(52) U.S. Cl.
CPC ..... *H01R 13/506* (2013.01); *H01R 9/03* (2013.01); *H01R 13/629* (2013.01)

(58) Field of Classification Search
CPC ..... H01R 13/6272; H01R 13/6275; H01R 13/506; H01R 13/629; H01R 9/03
USPC ..... 439/352
See application file for complete search history.

(56) References Cited

U.S. PATENT DOCUMENTS 8,444,430 B2 * 5/2013 Kappla ..... H01R 13/6275 439/352
8,545,252 B2 * 10/2013 Wang ..... H01R 13/6275 439/352
8,556,646 B2 * 10/2013 Kappla ..... G02B 6/4261 439/352
8,668,515 B2 * 3/2014 Wu ..... H01R 13/633 439/352
2013/0344728 A1 * 12/2013 Lim ..... H01R 24/60 439/352
2014/0193993 A1 * 7/2014 Meng ..... H01R 13/633 439/352

* cited by examiner

*Primary Examiner* — Gary F Paumen
(74) *Attorney, Agent, or Firm* — Rabin & Berdo, P.C.

(57) ABSTRACT

An electronic connector has a first shell, a second shell, a space, and at least one fixing unit. The first shell has a cover segment and at least one first assembling segment mounted securely on the cover segment. The second shell has at least one second assembling segment arranged with the first assembling segment of the first shell along the width direction of the electronic connector. The space is formed between the cover segment of the first shell and the second shell. The first assembling segment of the first shell is located in the space. The fixing unit is mounted through the first assembling segment of the first shell and the second assembling segment of the second shell along the width direction. Therefore, wires will not be restricted by the first assembling segment and the second assembling segment in the width direction.

17 Claims, 8 Drawing Sheets

ELECTRONIC CONNECTOR

BACKGROUND OF THE INVENTION

Field of the Invention

The present invention relates to an electronic connector for an electronic device.

Description of the Prior Arts

Due to the fast development of technologies such as 5G, AI, edge computing, and IOT, an amount of data that is required to be transmitted is also highly increased, so more transmission wires with larger diameters are needed to transmit the increased data. Besides, as a length of the transmission wire grows larger, a diameter of the transmission wire should be larger in order to meet the requirement of the transmission speed.

However, in a conventional electronic connector, the inner space gradually fails to meet the requirement for accommodating wider wires. Specifically, with reference to FIGS. 7 and 8, the conventional electronic connector has an inserting direction D1, a width direction D2, a thickness direction D3, a first shell 91, a second shell 92, two fixing units 93, and multiple wires 94. The second shell 92 has two assembling segments 921. The two assembling segments 921 are respectively located on two sides of the second shell 92 in the width direction D2, and the two assembling segments 921 extend inwards toward each other. The two fixing units 93 are mounted through the first shell 91 along the thickness direction D3, and are respectively mounted in the two assembling segments 921 of the second shell 92 along the thickness direction D3. The wires 94 are located in a space formed between the first shell 91 and the second shell 92, and are arranged along the width direction with the two assembling segments 921.

In this way, the wires 94 between the two shells are restricted in the width direction D2 by a distance between the two assembling segments 921 of the second shell 92, and therefore a diameter of each of the wires 94 is restricted. Further, in the abovementioned structure, a space 95 is still left in the thickness direction D3, and is not effectively used.

To sum up, how to effectively use the space between the two shells to enlarge the wire width that the shells can accommodate without changing the existing specifications of an appearance of the shells has become an urgent problem in this field, especially in response to the rapid increase in the amount of data transmission, and the requirement for more wires with larger diameters.

To overcome the shortcomings, the present invention provides an electronic connector to mitigate or obviate the aforementioned problems.

SUMMARY OF THE INVENTION

The main objective of the present invention is to provide an electronic connector whose inner space is effectively used to enlarge the wire width that the shells can accommodate.

The electronic connector has an inserting direction, a width direction, a thickness direction, an inverse inserting direction, a first shell, a second shell, a space, and at least one fixing unit. The inserting direction, the width direction, and the thickness direction are perpendicular to each other. The inverse inserting direction is opposite to the inserting direction. The first shell has a cover segment and at least one first assembling segment. The at least one first assembling segment is mounted securely on the cover segment. The second shell has at least one second assembling segment. The at least one second assembling segment and the at least one first assembling segment are arranged along the width direction. The space is formed between the second shell and the cover segment of the first shell. The at least one first assembling segment of the first shell is located in the space. The at least one fixing unit is mounted through the at least one first assembling segment of the first shell and the at least one second assembling segment of the second shell along the width direction to fix the first shell and the second shell.

By arranging the first assembling segment and the wire along the thickness direction in the space formed between the first shell and the second shell, aligning the first assembling segment to the second assembling segment, and mounting the fixing unit through the first assembling segment and the second assembling segment along the width direction to assemble the first shell and the second shell, the wire will not be restricted by the first assembling segment and the second assembling segment in the width direction. Therefore, compared to the conventional electronic connector, which has an assembling segment arranged with the wires along the width direction but leaves an unused space in the thickness direction, the present invention has an effectively used space in the thickness direction (that is, the space in the thickness direction is used for the fixing unit to mount through and assemble the two shells), thereby enlarging the wire width that the first shell and the second shell can accommodate.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
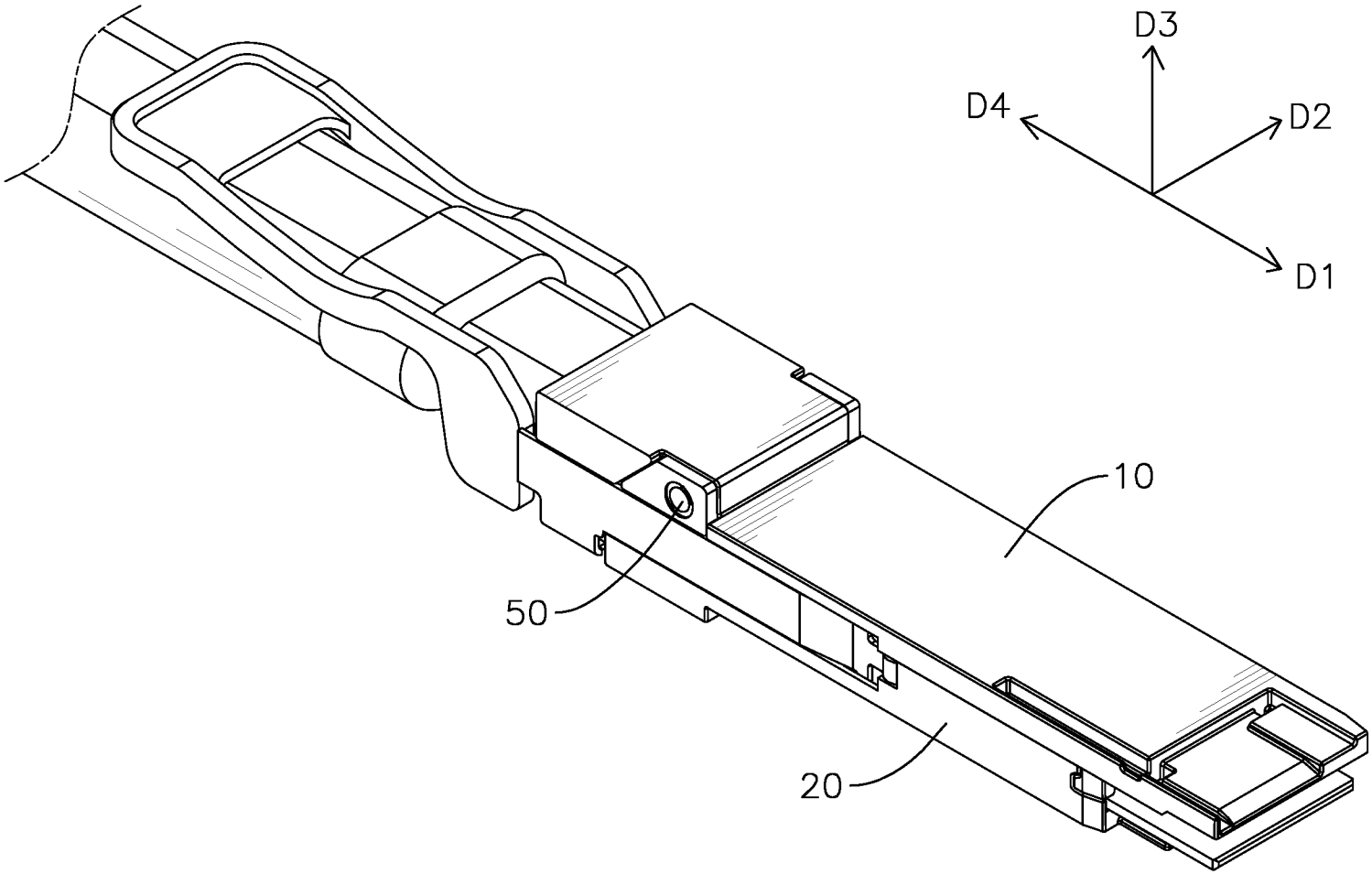
FIG. 1 is a perspective view of an electronic connector in accordance with the present invention.
Figure 2:
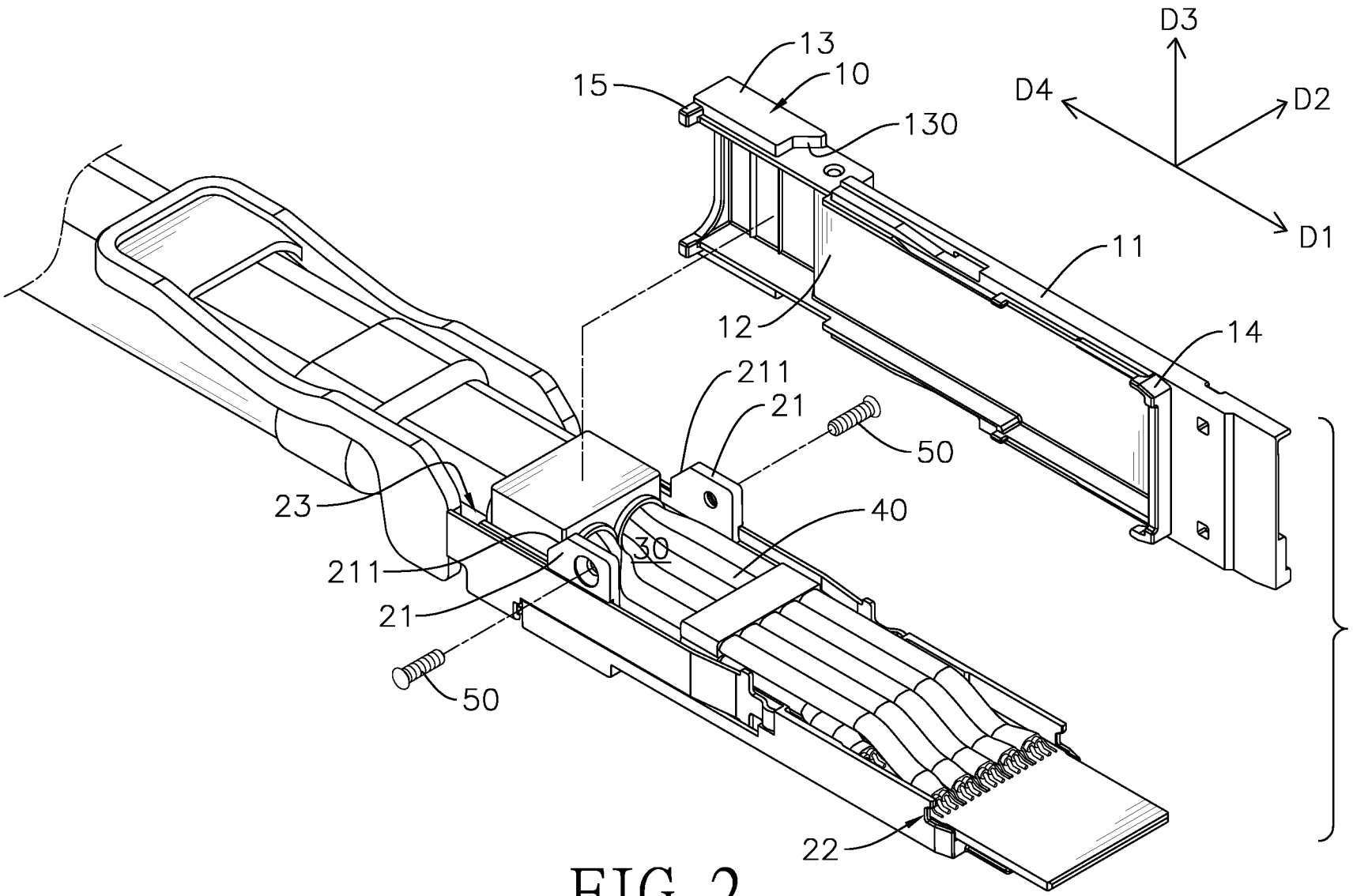
FIG. 2 is an exploded view of the electronic connector in FIG. 1.

With reference to FIGS. 1 and 2, an electronic connector in accordance with the present invention comprises an inserting direction D1, a width direction D2, a thickness direction D3, an inverse inserting direction D4, a first shell 10, a second shell 20, a space 30, multiple wires 40, and at least one fixing unit 50.

The inserting direction D1, the width direction D2, and the thickness direction D3 are perpendicular to each other, and the inverse inserting direction D4 is opposite to the inserting direction.

The first shell 10 has a cover segment 11 and at least one first assembling segment 12. The at least one first assembling segment 12 is mounted securely on the cover segment 11.

The second shell 20 has at least one second assembling segment 21. The at least one second assembling segment 21 and the at least one first assembling segment 12 of the first shell 10 are arranged along the width direction D2. Specifically, the at least one second assembling segment 21 and the at least one first assembling segment 12 are arranged along the width direction D2 in a straight line, in order to be mounted through and be fixed by the at least one fixing unit 50.

Figure 3:
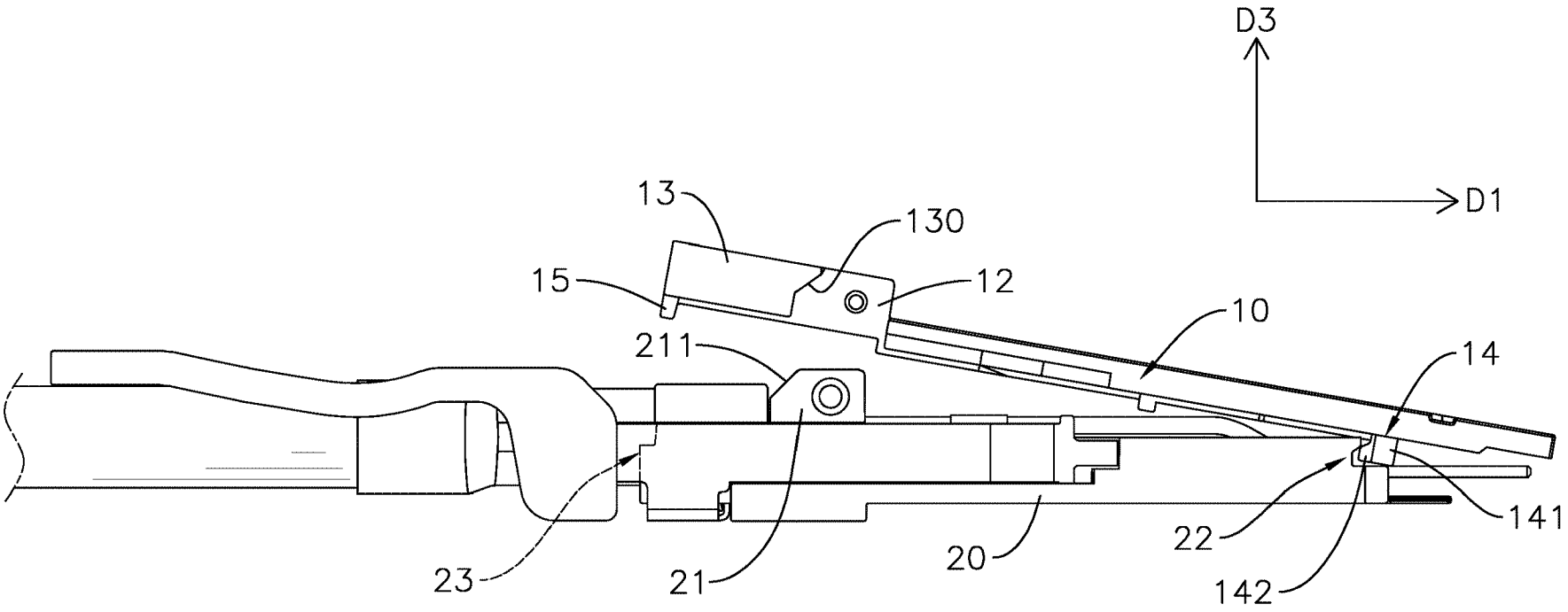
FIGS. 3 and 4 are operational views of the electronic connector in FIG. 1, showing the assembling of the first shell and the second shell.
Figure 4:
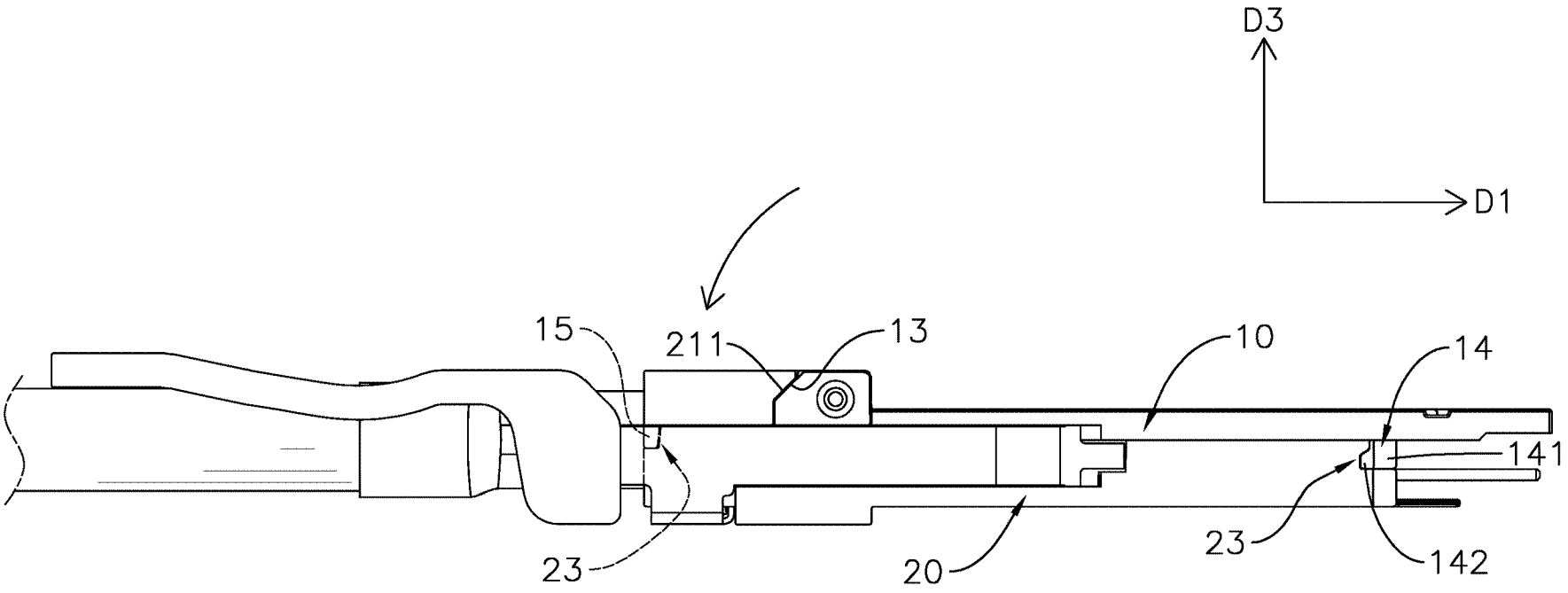

With further reference to FIGS. 2, 3, and 4, specifically, in this embodiment, an amount of the at least one first assembling segment 12 of the first shell 10 is one, and an amount of the at least one second assembling segment 21 of the second shell 20 is two. The two second assembling segments 21 extend along the thickness direction D3, are respectively located on two sides of the first shell 10 in the width direction D2, and clamp the first assembling segment 12.

Each of the second assembling segments 21 has a side surface located in the inverse inserting direction D4, wherein said side surface is a surface of the second assembling segment 21 that faces the inverse inserting direction D4. A second positioning inclined surface 211 is formed on the side surface of the second assembling segment 21 in the inverse inserting direction D4. A normal line of the second positioning inclined surface 211 is perpendicular to the width direction D2, is inclined with respect to the inserting direction D1 and the thickness direction D3, and extends toward the inverse inserting direction D4.

The first shell 10 further has at least one protruding segment 13 mounted securely on the cover segment 11. In this embodiment, an amount of the at least one protruding segment 13 is two, and the two protruding segments 13 protrude from the cover segment 11 respectively toward the width direction D2 and opposite to the width direction D2. Each of the protruding segments 13 abuts the side surface, which faces toward the inverse inserting direction D4, of the second assembling segment 21. Each of the protruding segments 13 has a first positioning inclined surface 130 being parallel to the second positioning inclined surface 211. The two first positioning inclined surfaces 130 of the two protruding segments 13 respectively abut the two second positioning inclined surfaces 211.

The amounts of the first assembling segment 12 and the second assembling segment 21 are not limited to the abovementioned, as the amounts of the first assembling segment 12 and the second assembling segment 21 can also both be two, and the two first assembling segments 12 are respectively assembled with the two second assembling segments 21, or the amounts of the first assembling segment 12 and the second assembling segment 21 can both be one. Further, the electronic connector of the present invention can also be implemented without the second positioning inclined surface 211 and the first positioning inclined surface 130, such that the first assembling segment 12 and the second assembling segment 21 can be positioned and aligned by any other structures.

Additionally, in this embodiment, the first shell 10 and the second shell 20 are arranged along the thickness direction D3, which means the first shell 10 and the second shell 20 are assembled with each other along the thickness direction D3 and are detached from each other opposite to the thickness direction D3. But the configuration of the first shell 10 and the second shell 20 is not limited to the abovementioned, as in another embodiment, the first shell 10 and the second shell 20 can also be arranged along the width direction D2.

In more detail, in this embodiment, the first shell 10 further has a first front end positioning segment 14 and a first rear end positioning segment 15, and the second shell 20 further has a second front end positioning segment 22 and a second rear end positioning segment 23.

The first front end positioning segment 14 is located in front of the first assembling segment 12 in the inserting direction D1, and the first front end positioning segment 14 has an extending segment 141 and a hook segment 142. The extending segment 141 extends toward the second shell 20. The hook segment 142 is formed on an end of the extending segment 141 and extends from the extending segment 141 along the inverse inserting direction D4. The first rear end positioning segment 15 is located in back of the first assembling segment 12 in the inserting direction D1. In this embodiment, the first rear end positioning segment 15 has a protrusion protruding toward a direction opposite to the thickness direction D3.

The second front end positioning segment 22 is located in front of the second assembling segment 21 in the inserting direction D1, and buckles the first front end positioning segment 14 of the first shell 10. The second front end positioning segment 22 is a notch with an opening facing toward the inserting direction D1. The hook segment 142 of the first front end positioning segment 14 engages with the notch. The second rear end positioning segment 23 is located in back of the second assembling segment 21 in the inserting direction D1, and buckles the first rear end positioning segment 15 of the first shell 10. The second rear end positioning segment 23 has a groove concaved toward the direction opposite to the thickness direction D3. The protrusion of the first rear end positioning segment 15 engages in the groove.

By the abovementioned configurations, when assembling the first shell 10 and the second shell 20, a user first aligns the first front end positioning segment 14 to the second front end positioning segment 22, and makes the first front end positioning segment 14 abut the second front end positioning segment 22 to form a pivot. After then, the user turns the first shell 10 to buckle the first rear end positioning segment 15 with the second rear end positioning segment 23. At the same time, the hook segment 142 engages in the notch via turning, and the assembling process of the first shell 10 and the second shell 20 is accomplished. In addition, while the user is turning the first shell 10, the first positioning inclined surface 130 cooperates with the second positioning inclined surface 211 to assist with positioning to facilitate the assembly.

Figure 5:
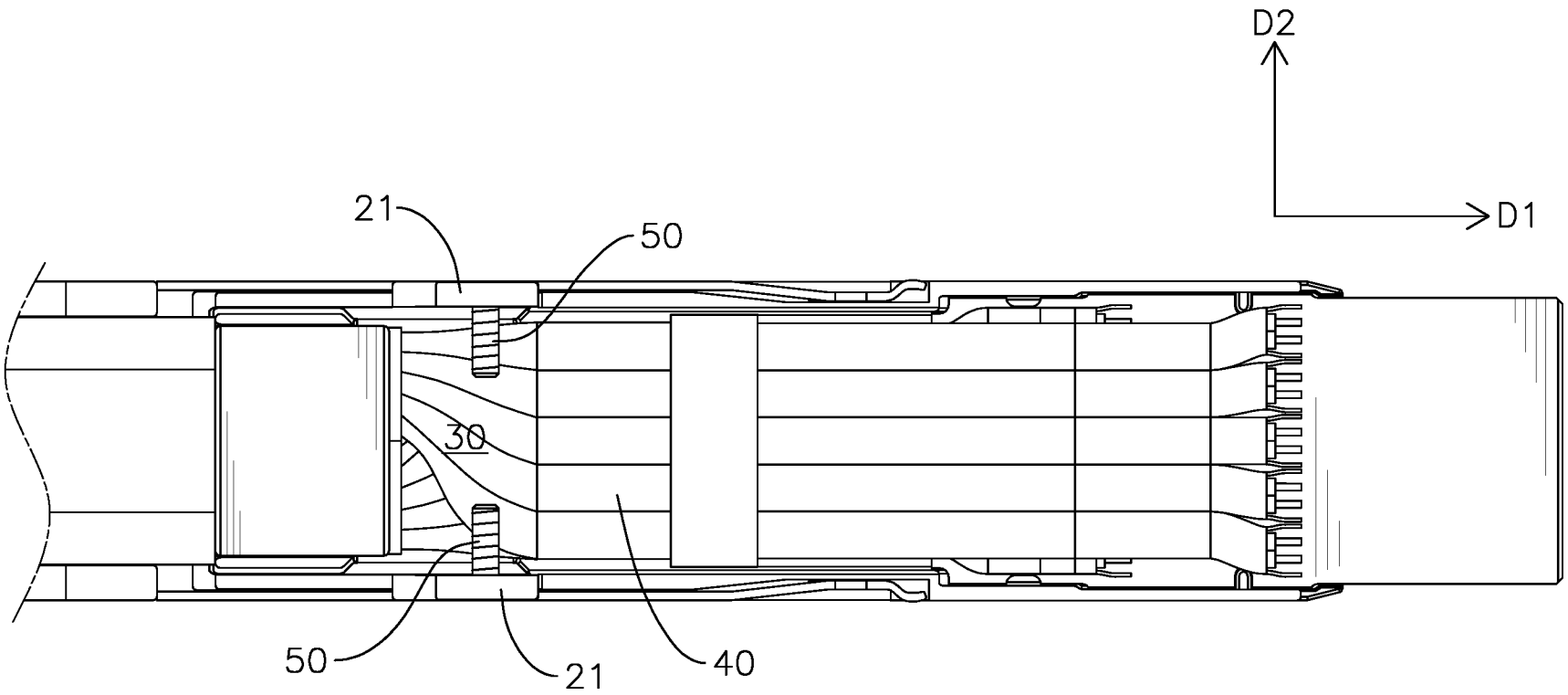
FIG. 5 is a top view of the electronic connector in FIG. 1, shown without the first shell.
Figure 6:
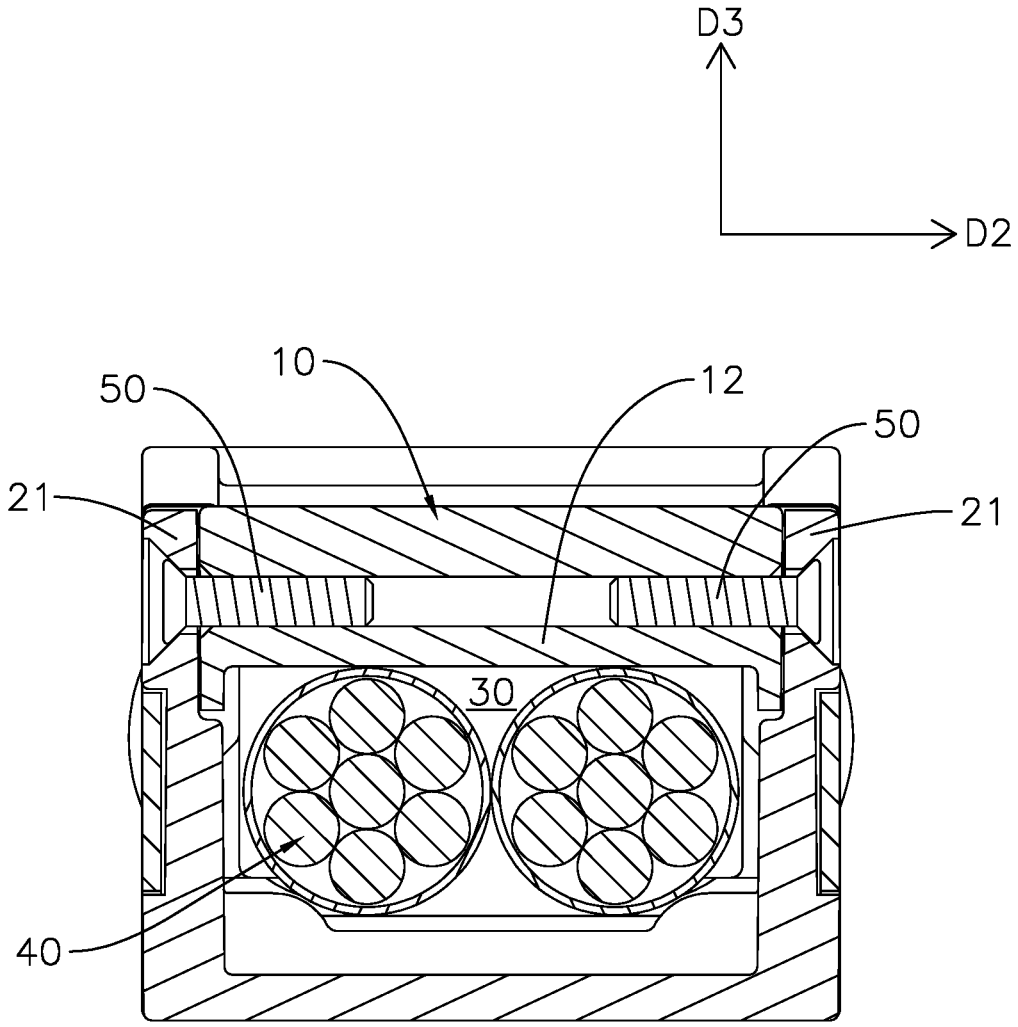
FIG. 6 is a front view in cross-section of the electronic connector in FIG. 1.
Figure 7:
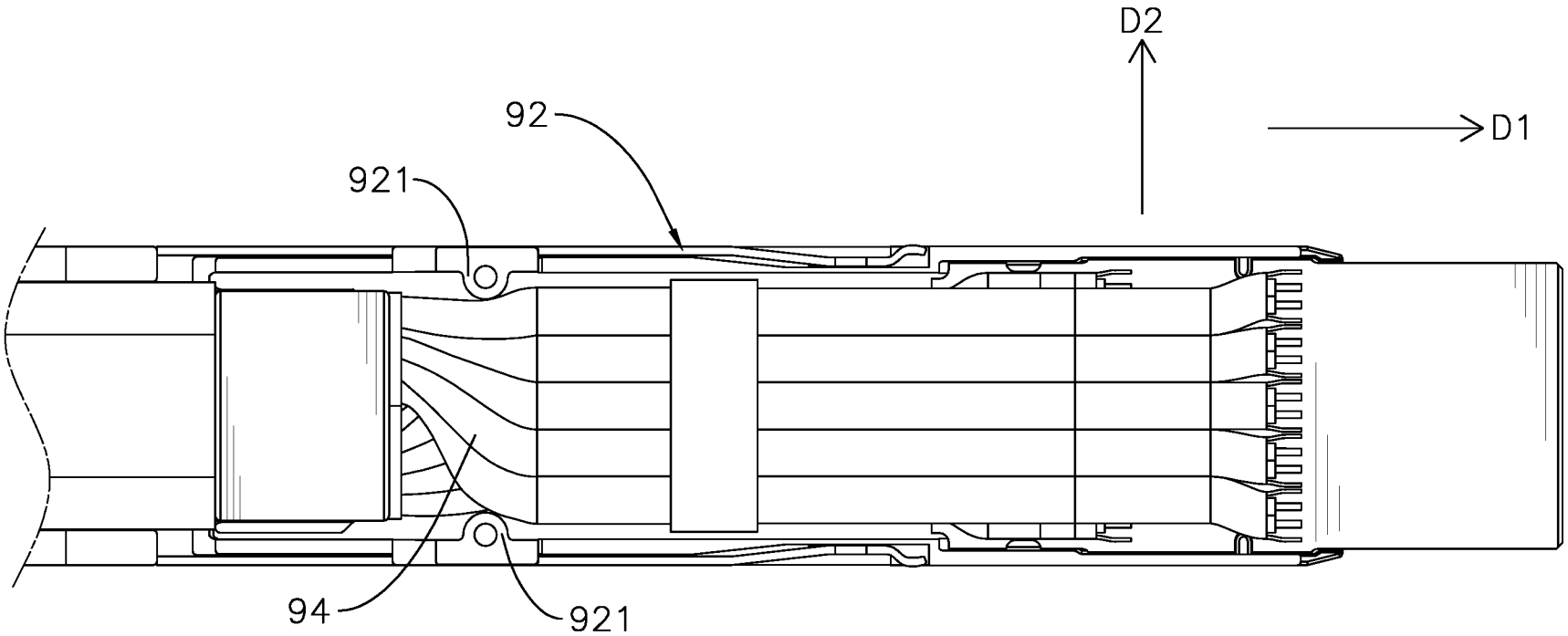
FIG. 7 is a top view of a conventional electronic connector, shown without the first shell.
Figure 8:
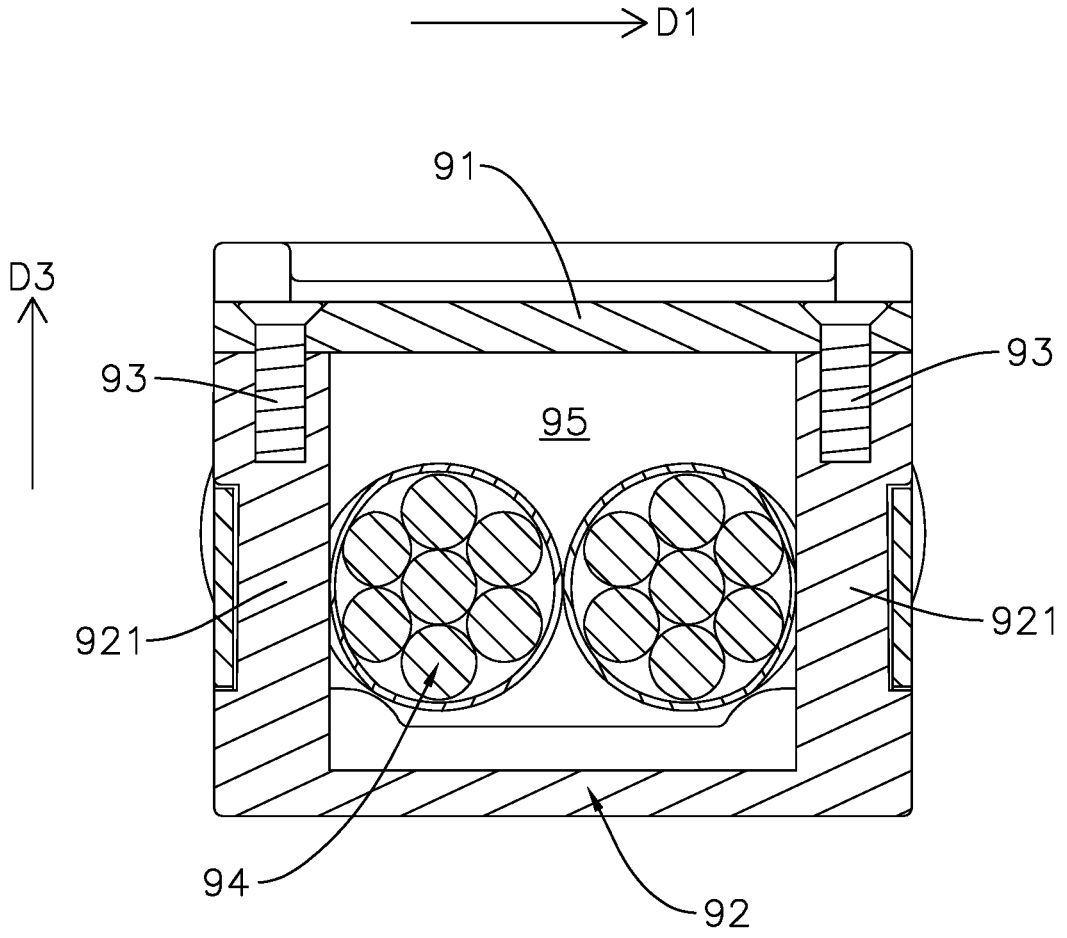
FIG. 8 is a front view in cross-section of the conventional electronic connector in FIG. 7.

With further reference to FIGS. 2, 5, and 6, the space 30 is formed between the cover segment 11 of the first shell 10 and the second shell 20, and the first assembling segment 12 of the first shell 10 is located in the space 30.

Multiple wires 40 are located in the space 30, extend along the inserting direction D1, and are arranged along the width direction D2. The wires 40 and the first assembling segment 12 of the first shell 10 are arranged along the thickness direction D3. Therefore, the wires 40 will not be squeezed or restricted by the first assembling segment 12, and therefore a diameter of the wires 40 is allowed to be enlarged.

The at least one fixing unit 50 is mounted through the first assembling segment 12 of the first shell 10 and the second assembling segment 21 of the second shell 20 along the width direction D2 to fix the first shell 10 and the second shell 20. Specifically, in this embodiment, an amount of the at least one fixing unit 50 is two, and the two fixing units 50 are respectively mounted through two opposite side surfaces of the first shell 10 in the width direction D2, and are respectively mounted through two opposite side surfaces of the second shell 20 in the width direction D2. But in other embodiments, the amount of the fixing unit 50 can also be one, and in this case, the single fixing unit 50 can be mounted through the two opposite side surfaces of each of the first shell 10 and the second shell 20 in the width direction D2.

By arranging the first assembling segment 12 and the wires 40 along the thickness direction D3 in the space 30 formed between the first shell 10 and the second shell 20, aligning the first assembling segment 12 to the second assembling segment 21, and mounting the fixing unit 50 through the first assembling segment 12 and the second assembling segment 21 along the width direction D2 to assemble the first shell 10 and the second shell 20, the wires 40 will not be restricted by the first assembling segment 12 and the second assembling segment 21 in the width direction D2. Therefore, the present invention has an effectively used space 30, thereby enlarging the wire width that the first shell 10 and the second shell 20 can accommodate.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An electronic connector comprising:

an inserting direction;

a width direction;

a thickness direction; the inserting direction, the width direction, and the thickness direction being perpendicular to each other;

an inverse inserting direction being opposite to the inserting direction;

a first shell having a cover portion; and at least one first assembling portion connected to the cover portion;

a second shell having at least one second assembling portion; the at least one second assembling portion and the at least one first assembling portion arranged along the width direction;

a space formed between the second shell and the cover portion of the first shell; the at least one first assembling portion of the first shell located in the space; and at least one fixing unit mounted through the at least one first assembling portion of the first shell and the at least one second assembling portion of the second shell along the width direction to fix the first shell and the second shell, wherein no wire is located on an imaginary extension line of an axis of each of the at least one fixing unit.

2. The electronic connector as claimed in claim 1, wherein the first shell further has a first front end positioning portion located in front of the at least one first assembling portion in the inserting direction; and the second shell further has a second front end positioning portion located in front of the at least one second assembling portion in the inserting direction, and buckling the first front end positioning portion of the first shell.

3. The electronic connector as claimed in claim 2, wherein the first front end positioning portion has an extending portion extending toward the second shell; and a hook portion formed on an end of the extending portion and extending from the extending portion along the inverse inserting direction; and the second front end positioning portion is a notch with an opening facing toward the inserting direction; wherein the hook portion of the first front end positioning portion engages with the notch.

4. The electronic connector as claimed in claim 2, wherein the first shell further has a first rear end positioning portion located in back of the at least one first assembling portion in the inserting direction; and the second shell further has a second rear end positioning portion located in back of the at least one second assembling portion in the inserting direction, and buckling the first rear end positioning portion of the first shell.

5. The electronic connector as claimed in claim 4, wherein the first rear end positioning portion has a protrusion protruding toward a direction opposite to the thickness direction; and the second rear end positioning portion has a groove concaved toward the direction opposite to the thickness direction; wherein the protrusion engages with the groove.

6. The electronic connector as claimed in claim 1, wherein the at least one fixing unit is mounted through two opposite side surfaces of the first shell in the width direction, and is mounted through two opposite side surfaces of the second shell in the width direction.

7. The electronic connector as claimed in claim 5, wherein the at least one fixing unit is mounted through two opposite side surfaces of the first shell in the width direction, and is mounted through two opposite side surfaces of the second shell in the width direction.

8. The electronic connector as claimed in claim 1, wherein the first shell and the second shell are arranged along the thickness direction.

9. The electronic connector as claimed in claim 7, wherein the first shell and the second shell are arranged along the thickness direction.

10. The electronic connector as claimed in claim 1, wherein the first shell further has at least one protruding portion mounted securely on the cover portion, and abutting a side surface of the at least one second assembling portion in the inverse inserting direction.

11. The electronic connector as claimed in claim 9, wherein the first shell further has at least one protruding portion mounted securely on the cover portion, and abutting a side surface of the at least one second assembling portion in the inverse inserting direction.

12. The electronic connector as claimed in claim 10, wherein the at least one second assembling portion has a second positioning inclined surface located on the side surface of the at least one second assembling portion in the inverse inserting direction; a normal line of the second positioning inclined surface being perpendicular to the width direction, being inclined with respect to the inserting direction and the thickness direction, and extending toward the inverse inserting direction; and the at least one protruding portion has a first positioning inclined surface being parallel to the second positioning inclined surface, and abutting the second positioning inclined surface.

13. The electronic connector as claimed in claim 11, wherein the at least one second assembling portion has a second positioning inclined surface located on the side surface of the at least one second assembling portion in the inverse inserting direction; a normal line of the second positioning inclined surface being perpendicular to the width direction, being inclined to the inserting direction and the thickness direction, and extending toward the inverse inserting direction; and the at least one protruding portion has a first positioning inclined surface being parallel to the second positioning inclined surface, and abutting the second positioning inclined surface.

14. The electronic connector as claimed in claim 1, wherein the second sell has a sliding groove formed below each of the at least one second assembling portion for receiving an arm of a latch.

15. The electronic connector as claimed in claim 1, wherein the first shell further has a first front end positioning portion located in front of the at least one first assembling portion in the inserting direction; and a first rear end positioning portion located in back of the at least one first assembling portion in the inserting direction;

the second shell further has a second front end positioning portion located in front of the at least one second assembling portion in the inserting direction, and buckling the first front end positioning portion of the first shell; and a second rear end positioning portion located in back of the at least one second assembling portion in the inserting direction, and buckling the first rear end positioning portion of the first shell; and the at least one fixing unit is located between the first front end positioning portion and the first rear end positioning portion in the inserting direction.

16. An electronic connector comprising:

an upper shell having two upper assembling portions;

a lower shell having two lateral sliding grooves and two lower assembling portions, each of the lateral sliding grooves being formed on an outer lateral surface of the lower shell respectively;

a latch having two arms and a handle connected to both of the arms, each of the arms being movably disposed in a respective one of the lateral sliding grooves;

at least two fixing units extending along a width direction and penetrating through both of the upper assembling portion and the lower assembling portion for securing the upper shell with the lower shell; and a plurality of wires, at least a part of the wires being located in an accommodating space formed between the upper shell and the lower shell, none of the wires being located on an imaginary extension line of an axis of each of the at least two fixing units.

17. The electronic connector as claimed in claim 16, wherein each of the at least two fixing units is located above all of the wires.

* * * * *